US007686078B2

(12) United States Patent
Khomynets

(10) Patent No.: US 7,686,078 B2
(45) Date of Patent: Mar. 30, 2010

(54) WELL JET DEVICE AND THE OPERATING METHOD THEREOF

(76) Inventor: Zinoviy Dmitrievich Khomynets, kv.4, d.46, Zeleny pr-t, Moscow (RU) 111396

( * ) Notice: Subject to any disclaimer, the term of this patent is extended or adjusted under 35 U.S.C. 154(b) by 0 days.

(21) Appl. No.: 12/089,910

(22) PCT Filed: Jul. 7, 2006

(86) PCT No.: PCT/RU2006/000357

§ 371 (c)(1),
(2), (4) Date: Apr. 10, 2008

(87) PCT Pub. No.: WO2007/061335

PCT Pub. Date: May 31, 2007

(65) Prior Publication Data

US 2008/0264634 A1 Oct. 30, 2008

(30) Foreign Application Priority Data

Nov. 25, 2005 (RU) ..... 2005136546

(51) Int. Cl.
*E21B 47/00* (2006.01)

(52) U.S. Cl. ..... 166/254.2; 166/250.07; 166/305.1

(58) Field of Classification Search ..... 166/222, 166/223, 254.2, 66, 68, 105, 250.11, 372; 175/424

See application file for complete search history.

(56) References Cited

U.S. PATENT DOCUMENTS

| | | | | |
|---|---|---|---|---|
| 4,648,455 | A * | 3/1987 | Luke | 166/303 |
| 4,744,730 | A * | 5/1988 | Roeder | 417/172 |
| 5,337,819 | A * | 8/1994 | Tailby | 166/222 |
| 6,708,763 | B2 * | 3/2004 | Howard et al. | 166/303 |
| 6,962,197 | B2 * | 11/2005 | Khomynets | 166/254.2 |
| 7,549,478 | B2 * | 6/2009 | Khomynets | 166/372 |
| 2008/0245572 | A1 * | 10/2008 | Khomynets | 175/57 |
| 2008/0314595 | A1 * | 12/2008 | Khomynets | 166/308.2 |

* cited by examiner

*Primary Examiner*—Jennifer H Gay
*Assistant Examiner*—Blake Michener
(74) *Attorney, Agent, or Firm*—patenttm.us

(57) ABSTRACT

Well jet device comprises a packer on a pipe string, with a central channel and a jet pump, comprising channels for supplying a working medium to a nozzle and supplying a medium pumped from the well. A diffuser output connects to the annular space and the nozzle connects to the pipe string internal cavity on the side of the input thereof through the channels. The body has a movable steady bush, spring-loaded working medium flow switch. Steady bush bypass holes and mounting seat for mounting a sealing unit provided with a hole for passing a logging cable or for arranging a depression insert provided with autonomous instruments and a return valve are provided. The sleeve, in the top position, closes the channels and, in lower position, the top end face is positioned under the input into the channel. The bypass holes are connected to the input into the channel.

2 Claims, 3 Drawing Sheets

WELL JET DEVICE AND THE OPERATING METHOD THEREOF

FIELD OF THE INVENTION

This invention relates to pump engineering, primarily to well pump units used in testing and developing oil and gas wells.

PRIOR ART

A well jet device is known, which comprises, arranged on a pipe string from bottom to top, a packer with a central channel defined therein and a jet pump, the jet pump body comprising an active nozzle and a mixing chamber with a diffuser as well as a channel for supplying a working medium and a channel for supplying a medium pumped out of a well, wherein the jet pump body is provided with a through channel for the purpose of installing replaceable functional inserts and a sealing unit therein (RU 2176336 C1).

The same patent teaches a method of operating a well jet device, including arranging a jet pump on a flow string in a well and pumping chemical agents via the flow string into a formation subject to subsequent pumping reaction products out of the formation, wherein a blocking insert with a through channel is firstly installed in the through channel made in the jet pump body, and then the blocking insert is replaced by a depression insert, a working medium is supplied to the jet pump nozzle via the flow string, thus creating a controlled pressure in the under-packer area for the purpose of draining the formation and carrying out other scheduled works.

This well jet device enables to treat a formation below the level at which a jet pump is installed in a well, including treatments carried out after creating a pressure differential above and below a sealing unit. However, the capabilities of the well jet device are not used in full due to long times required for replacing inserts, wherein such time is often longer than estimated time of the reaction between an acid solution and minerals of a producing formation.

The closest to this invention as to its technical essence and achieved result is a well jet device comprising a packer with a central channel made therein and a jet pump, both being arranged on a pipe string, wherein an active nozzle, a mixing chamber with a diffuser, and a channel for supplying a working medium, a channel for supplying a medium pumped out of a well are made in the body of the jet pump, a working medium flow switch being installed in the body of the jet pump, the jet pump output being connected to the annular space surrounding the pipe string, the jet pump nozzle being connected, via the channel for supplying a working medium, to the pipe string inner cavity above the switch, and the channel for supplying a medium pumped out of a well is connected to the pipe string inner cavity below the packer (RU 2222717 C1).

A method of operating a well jet device is known from the said patent, which consists in that a packer and a jet pump having a working medium flow switch installed therein are lowered into a well on a pipe string, the packer and the jet pump are arranged over the top of a producing formation, and the packer is released. Then a working medium is injected to the jet pump nozzle with the use of a pump unit at regular intervals, thus creating a pressure drawdown to the producing formation, then the flow direction of the working medium is reversed, and back-pressure on the producing formation is created as a hydraulic blow by acting on the producing formation with the working medium pressure from the pipe string. After that the supply of all the working medium is abruptly switched to the jet pump nozzle, which allows to repeat the above-described cycle of acting on the near-well area of the producing formation by pressure drawdown and back-pressure, while determining a degree to which permeability of the near-well area of the producing formation is restored by regularly taking check measurements of the well production rate before and during cyclic actions on the near-well area of the producing formation, with the possibility of injecting an acid solution to the producing formation by the jet pump.

This well jet device enables to switch over the working medium flow and act on a producing formation by creating pressure drawdown and back-pressure. However, the flow switch used creates significant hydraulic resistance and occupies the flow section of the pipe string, which does not enable to lower equipment and various instruments, e.g., measuring instruments, flexible tubes for injecting chemical agents or a hydrofracturing fluid in a formation, and instruments used for acting on formations, into a well, which narrows the capabilities of this well jet device and those of its method of operation.

BRIEF DESCRIPTION OF THE INVENTION

The objective of this invention is to raise quality of works on increasing well production rates due to improving technologies of treating producing formation with liquid agents.

The technical effect achieved by realizing this invention is improvements in work reliability and the well jet device capacity when treating a producing formation.

The stated objective in respect of the device can be solved, and the stated technical effect can be achieved due to the fact that the inventive well jet device comprises, arranged on a pipe string from bottom to top, a packer with a central channel defined therein and a jet pump, the jet pump body comprising a nozzle and a mixing chamber with a diffuser as well as a channel for supplying a working medium to the nozzle and a channel for supplying a medium pumped out of a well, the diffuser output being connected to the annular space surrounding the pipe string, and the jet pump nozzle, through the channel for supplying a working medium, and the input of the channel for supplying a medium pumped out of a well are connected to the inner cavity of the pipe string, a working medium flow switch is installed in the jet pump body coaxially with the pipe string, the switch being made as a supporting sleeve axially movable and spring-loaded against the body, the sleeve having bypass openings as well as a mounting seat for the purpose of installing onto it a sealing unit lowered through the pipe string, said sealing unit having an axial opening for passing through it a logging cable or a wire with logging instruments hung thereon and used for measuring physical parameters of a well and a medium pumped out of it, and for determining its production rate, or for installing onto the mounting seat a depression insert with self-contained instruments hung below it and used for measuring physical parameters of a medium pumped out of a well with the possibility of recording formation pressure recovery curves for the under-packer space, wherein, when the supporting sleeve is in its initial upper position, the channel for supplying a working medium and the channel for supplying a pumped-out medium are closed by the sleeve, and when the supporting sleeve is in its lower position its upper end is located below the input of the channel for supplying a working medium, the bypass openings of the supporting sleeve being in communication with the input of the channel for supplying a medium pumped out of a well.

The stated objective in respect of the method can be solved, and the stated technical effect can be achieved due to the fact that the method of operating the well jet device consist in that a packer and a jet pump are lowered into a well on a pipe string, the channels for supplying a working medium and supplying a pumped-out medium in the jet pump being closed by the supporting sleeve that is spring-loaded against the jet pump body, the packer is released and pressure tested by injecting a pressurized working medium into the well annular space, and then an acid solution or a hydrofracturing fluid is pumped into a producing formation in the well, logging instruments are lowered through the pipe string into the well on a logging cable or a wire passed through the axial opening of the sealing unit, the logging instruments are arranged in the area of the producing formation, and the sealing unit is installed onto the mounting seat in the supporting sleeve located in the jet pump body, geo-physical parameters in the under-packer area, including those in the area of the producing formation, are recorded, then a pressurized working medium is injected through the pipe string, which acts on the sealing unit, thus moving the supporting sleeve to its lower position, opening the input of the channel for supplying a working medium to the nozzle and establishing communication between the bypass openings and the input of the channel for supplying a medium pumped out of a well, then the well is drained by injecting a pressurized working medium through the channel for supplying a working medium to the jet pump nozzle, and reaction products and/or a hydrofracturing fluid are removed from the producing formation, while regularly measuring the well production rate with the use of logging instruments at various values of pressure drawdown on the producing formation and continuously recording bottom-hole pressures and the composition of a liquid medium pumped out of the producing formation, further, in the course of draining the well, the logging instruments are moved along the well bore for the purpose of recording geo-physical parameters in the under-packer area, including those in the area of the producing formation; and, afterwards, the supply of a working medium is stopped, the logging instruments are removed from the well together with the sealing unit and the logging cable or the wire, thus moving the spring-loaded supporting sleeve into its upper position, and a depression insert, together with a check valve and self-contained instruments arranged below the depression insert, is installed onto the mounting seat; then a pressurized working medium is injected through the pipe string and, under the influence of said working medium, the supporting sleeve is moved into its lower position, and the producing formation is drained for the second time, then the supply of the working medium into the jet pump nozzle is stopped, and a formation pressure recovery curve is recorded for the under-packer space of the well with the use of the self-contained instruments.

A conducted analysis of the well jet device operation has shown that the device operation reliability and efficiency may be increased by optimizing the device design and, thereby, it becomes possible to clean near-well areas of producing formations in wells more fully and to shorten time required for conducting such operations.

It has been found that hydrodynamic influence on the near-well area enables to use the well jet device most efficiently while developing and repairing oil and gas wells in the course of works on intensifying oil inflow from a producing formation. The inventive well jet device enables to take check measurements both before and during treatment, which, in its turn, enables to assess the technical condition of a well and properties of a medium pumped out of a well. After studying an inflow it becomes possible to assess quality of treatment of the near-well area of a producing formation. Making the well jet device with a working medium flow switch in the form of a supporting sleeve spring-loaded against the body enables treating of a producing formation by injecting chemical agents and/or a hydrofracturing fluid. Such a supporting sleeve closes the channels for supplying a working medium and a pumped-out medium, thus preventing them from plugging. Making a supporting sleeve with a mounting seat enables to install various technological equipment into the sleeve and conduct hydrodynamic treatment of a producing formation as well as make measurements, including recording of a formation pressure recovery curve for the under-packer area, as well as create stepwise pressure drawdown on a producing formation and clean it from mud particles and products of a reaction after treating a producing formation with chemical agents. Thus, it becomes possible to increase a radius and quality of treatment of the producing formation near-well area, while significantly equalizing the inflow profile due to a fuller coverage of such a producing formation throughout its depth with hydrodynamic action.

DESCRIPTION OF PREFERRED EMBODIMENTS

Figure 1:
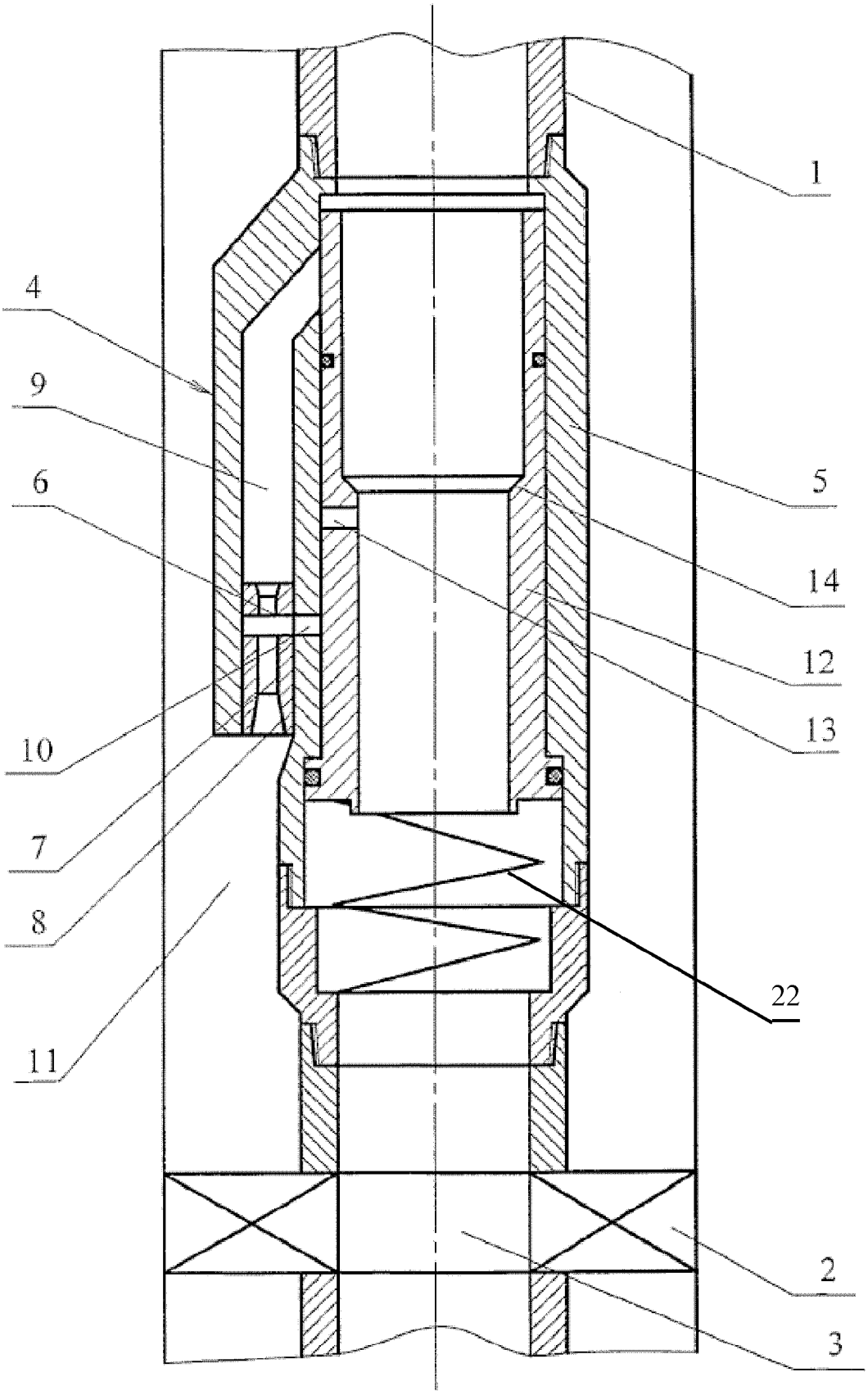
FIG. 1 shows the claimed well jet device intended for realization of the described method of operation when treating a producing formation with chemical agents or a hydrofracturing fluid.
Figure 2:
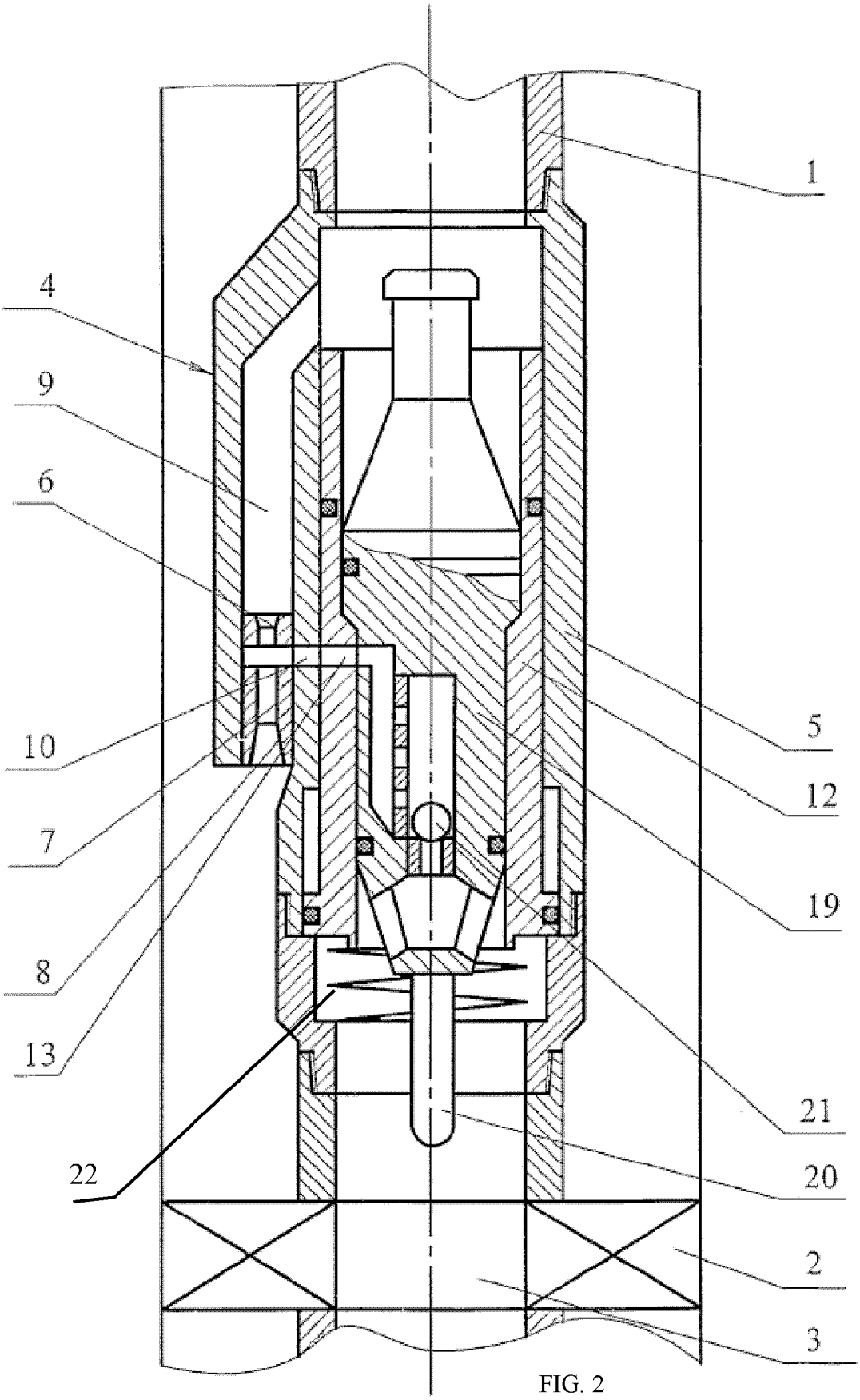
FIG. 2 shows the claimed well jet device with a depression insert, together with a check valve and self-contained instruments, installed in the supporting sleeve.
Figure 3:
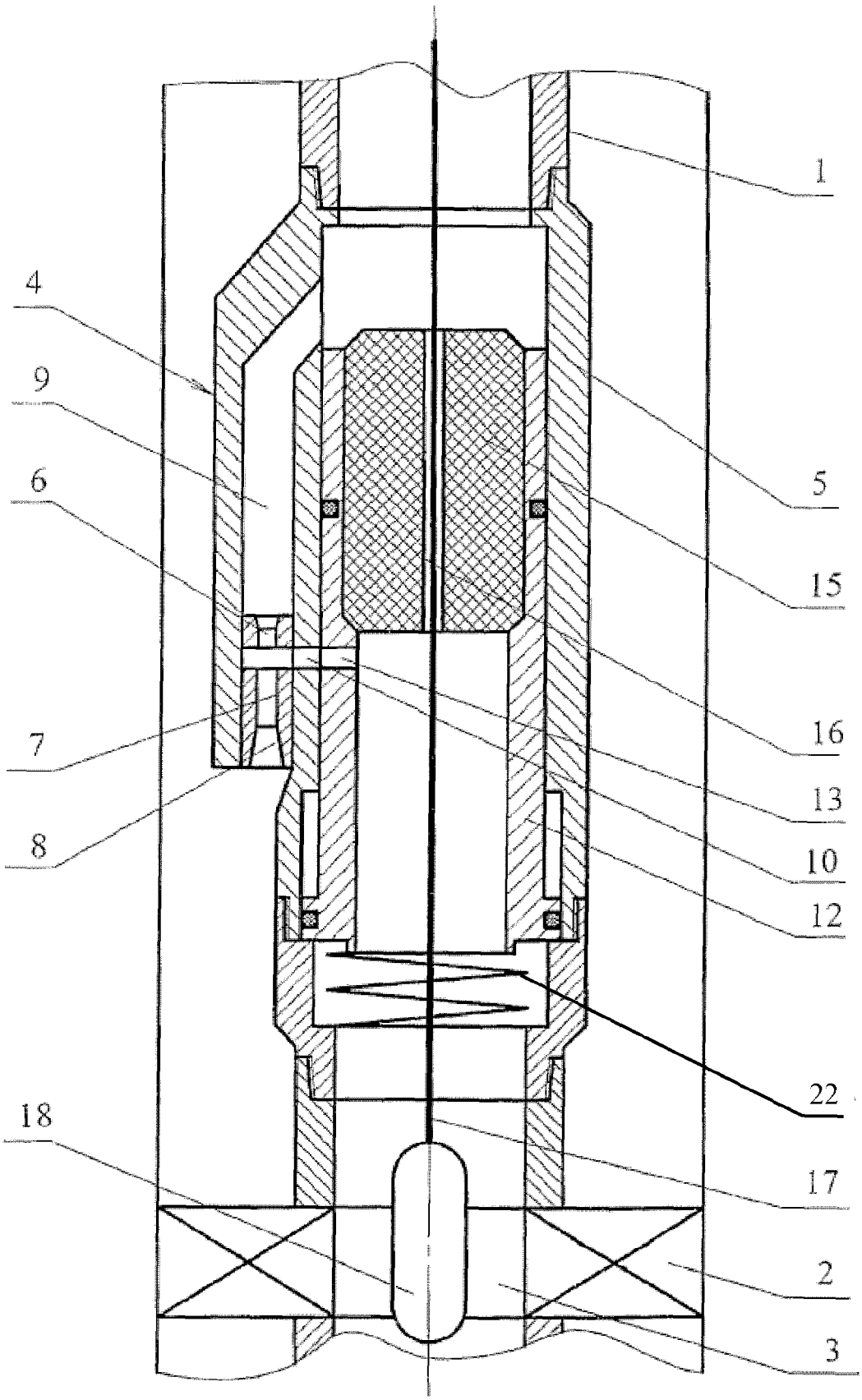
FIG. 3 shows the claimed well jet device with a sealing unit installed in the supporting sleeve.

The inventive well jet device comprises, arranged on a pipe string 1 from bottom to top, a packer 2 with a central channel 3 defined therein defined therein and a jet pump 4, which body 5 comprises a nozzle 6 and a mixing chamber 7 with a diffuser 8 as well as a channel 9 for supplying a working medium to the nozzle 6 and a channel 10 for supplying a medium pumped out of a well. The output of the diffuser 8 is connected to the annular space 11 surrounding the pipe string 1, and the nozzle 6 of the jet pump 4, through the channel 9 for supplying a working medium, and the input of the channel 10 for supplying a medium pumped out of a well are connected to the inner cavity of the pipe string 1. A working medium flow switch is installed in the body 5 of the jet pump 4 coaxially with the pipe string 1, the switch being made as a supporting sleeve 12 axially movable and spring-loaded by spring 22 against the body 5. The supporting sleeve 12 has bypass openings 13 and a mounting seat 14 for the purpose of installing onto it a sealing unit 15 lowered through the pipe string 1, said sealing unit 15 having an axial opening 16 for passing through it a logging cable 17 or a wire with logging instruments 18 hung thereon and used for measuring physical parameters of a well and a medium pumped out of it, e.g., pressure, temperature, etc., and for determining its production rate, or for installing onto the mounting seat 14 a depression insert 19 with self-contained instruments 20 hung below it and used for measuring physical parameters of a medium pumped out of a well with the possibility of recording formation pressure recovery curves for the under-packer space. A check valve 21 is installed in the depression insert 19. When the supporting sleeve 12 is in its initial upper position, the channels 9 and 10 are closed by the sleeve, and when the supporting sleeve 12 is in its lower position its upper end is located below the input of the channel 9 for supplying a working medium, and the bypass openings 13 of the supporting sleeve 12 are in communication with the input of the channel 10 for supplying a medium pumped out of a well.

The claimed method of operating the well jet device is carried out as follows.

A packer 2 and a jet pump 4 are lowered into a well on a pipe string 1, the channels 9 and 10 being closed by the supporting sleeve 12 that is spring-loaded by spring 22 against the body 5 of the jet pump 4. The packer 2 is released and pressure tested by injecting a pressurized working medium into the well annular space 11. Then an acid solution or a hydrofracturing fluid is pumped into a producing formation in the well, and logging instruments 18 are lowered through the pipe string 1 into the well on a logging cable 17 or a wire passed through the axial opening 16 of the sealing unit 15, the logging instruments 18 are arranged in the area of the producing formation, and the sealing unit 15 is installed onto the mounting seat 14 in the supporting sleeve 12. Geo-physical parameters, in particular pressure and temperature, in the under-packer area, including those in the area of the producing formation, are recorded. Then a pressurized working medium is injected through the pipe string 1, which acts on the sealing unit 15, thus moving the supporting sleeve 12 to its lower position, opening the input of the channel 9 for supplying a working medium to the nozzle 6 and establishing communication between the bypass openings 13 and the input of the channel 10 for supplying a medium pumped out of a well. The well is drained by injecting a pressurized working medium through the channel 9 for supplying a working medium to the nozzle 6 of the jet pump 4, and reaction products and/or a hydrofracturing fluid are removed from the producing formation, while regularly measuring the well production rate with the use of logging instruments at various values of pressure drawdown on the producing formation and continuously recording bottom-hole pressures and the composition of a liquid medium pumped out of the producing formation. Further, in the course of draining the well, the logging instruments 18 are moved along the well bore for the purpose of recording geo-physical parameters in the under-packer area, including those in the area of the producing formation. Afterwards, the supply of a working medium is stopped, the logging instruments 18 are removed from the well together with the sealing unit 15 and the logging cable 17 or the wire, thus moving the spring-loaded supporting sleeve 12 into its upper position, and a depression insert 19, together with a check valve and the self-contained instruments 20 arranged below the depression insert, is installed onto the mounting seat 14 in the supporting sleeve 12; then a pressurized working medium is injected through the pipe string 1 and, under the influence of said working medium, the supporting sleeve 12 is moved into its lower position, and the producing formation is drained for the second time, and then the supply of the working medium into the nozzle 6 of the jet pump 4 is stopped, and a formation pressure recovery curve is recorded for the under-packer space of the well with the use of the depression insert 18 and the self-contained instruments 20.

INDUSTRIAL APPLICABILITY

The present invention may be used in the oil and gas industry for well development after drilling or for underground repairs of wells for the purpose of intensifying hydrocarbons production rates or increasing intake capacity of injection wells.

What is claimed is:

1. A well jet device, comprising, arranged on a pipe string from bottom to top, a packer with a central channel defined therein and a jet pump, said jet pump having a body comprising a nozzle and a mixing chamber with a diffuser and a channel for supplying a working medium to the nozzle and a channel for supplying a medium pumped out of a well, the diffuser output being connected to an annular space surrounding the pipe string, and the jet pump nozzle, through the channel for supplying a working medium, and the input of the channel being connected to the inner cavity of the pipe string, a working medium flow switch being installed in the jet pump body coaxially with the pipe string, the switch being made as a supporting sleeve axially movable and spring-loaded against the body, the sleeve having bypass openings as well as a mounting seat for the purpose of installing onto it a sealing unit lowered through the pipe string, said sealing unit having an axial opening for passing therethrough a logging cable or a logging instruments wire used for measuring physical parameters of a well and a medium pumped out, and for determining its production rate, or for installing onto the mounting seat a depression insert with a check valve and self-contained instruments hung therebelow and used for measuring physical parameters of a medium pumped out of a well and capable of recording formation pressure recovery curves for the under-packer space, wherein, when the supporting sleeve is in its initial upper position, the channel for supplying a working medium and the channel for supplying a pumped-out medium are closed by the sleeve, and when the supporting sleeve is in its lower position its upper end is located below the input of the channel for supplying a working medium, said bypass openings of the supporting sleeve being in communication with the input of the channel for supplying a medium pumped out of a well.

2. A method of operating a well jet device, wherein a packer and a jet pump are lowered into a well on a pipe string, a channel for supplying a working medium and a channel for supplying a pumped-out medium in the jet pump are closed by a supporting sleeve that is spring-loaded against a body of the jet pump, the packer is released and pressure tested by injecting a pressurized working medium into a well annular space, and then an acid solution or a hydrofracturing fluid is pumped into a producing formation in the well, logging instruments are lowered through the pipe string into the well on a logging cable or a wire passed through the axial opening of a sealing unit, the logging instruments are arranged in the area of the producing formation, and the sealing unit is installed onto a mounting seat in the supporting sleeve located in the jet pump body, geo-physical parameters in the under-packer area are recorded, including parameters in the area of the producing formation, then a pressurized working medium is injected through the pipe string, which acts on the sealing unit, thus moving the supporting sleeve to its lower position, opening an input of the channel for supplying a working medium to the nozzle and establishing communication between bypass openings in the sleeve and the input of the channel for supplying a medium pumped out of a well, then the well is drained by injecting a pressurized working medium through the channel for supplying a working medium to the jet pump nozzle, and reaction products and/or a hydrofracturing fluid are removed from the producing formation, while regularly measuring the well production rate with the use of logging instruments at various values of pressure drawdown on the producing formation and continuously recording bottom-hole pressures and the composition of a liquid medium pumped out of the producing formation, further, in the course of draining the well, the logging instruments are moved along the well bore for the purpose of recording geo-physical parameters in the under-packer area, including those in the area of the producing formation, and, afterwards, the supply of a working medium is stopped, the logging instruments are removed from the well together with the sealing unit and the logging cable or the wire, thus moving the spring-loaded supporting sleeve into its upper position, and a depression insert, together with a check valve and self-contained instruments arranged below the depression insert, is installed onto the mounting seat, then a pressurized working medium is injected through the pipe string and, under the influence of said working medium, the supporting sleeve is moved into its lower position, and the producing formation is drained for the second time, then the supply of the working medium into the jet pump nozzle is stopped, and a formation pressure recovery curve is recorded for the under-packer space of the well with the use of the self-contained instruments.

* * * * *